US006663257B2

(12) United States Patent
Galli

(10) Patent No.: US 6,663,257 B2
(45) Date of Patent: Dec. 16, 2003

(54) FLASHLIGHT WITH REMOVABLE POCKET KNIFE

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 0 days.

(21) Appl. No.: 10/197,364

(22) Filed: Jul. 16, 2002

(65) Prior Publication Data

US 2003/0016531 A1 Jan. 23, 2003

Related U.S. Application Data

(60) Provisional application No. 60/306,517, filed on Jul. 19, 2001.

(51) Int. Cl.[7] ..... F21V 33/00; B25B 23/18

(52) U.S. Cl. ..... 362/119; 362/102; 362/109; 362/208; 362/800

(58) Field of Search ..... 362/102, 109, 362/119, 208, 800

(56) References Cited

U.S. PATENT DOCUMENTS

| | | | | | |
|---|---|---|---|---|---|
| D350,271 | S | | 9/1994 | Landy et al. | |
| D353,011 | S | | 11/1994 | Miller | |
| 5,857,268 | A | * | 1/1999 | Park | 30/146 |
| D408,256 | S | | 4/1999 | Maxcy | |
| D412,355 | S | | 7/1999 | Saetherbo | |
| 6,050,698 | A | * | 4/2000 | Lee | 362/120 |
| 6,089,729 | A | * | 7/2000 | Chang | 362/120 |
| 6,186,638 | B1 | * | 2/2001 | Chang | 362/119 |
| 6,283,606 | B1 | * | 9/2001 | Wei et al. | 362/119 |
| 6,334,693 | B1 | * | 1/2002 | Lee | 362/119 |
| 6,347,875 | B1 | * | 2/2002 | Painsith | 362/119 |
| 6,454,427 | B1 | * | 9/2002 | Chen | 362/119 |

* cited by examiner

*Primary Examiner*—Sandra O'Shea
*Assistant Examiner*—Jacob Y. Choi
(74) *Attorney, Agent, or Firm*—Barlow, Josephs & Holmes, Ltd.

(57) ABSTRACT

A combination tool construction is provided that combines a high intensity flashlight and a standard, popular sized pocketknife. The handle portion of the flashlight housing is constructed to slideably receive a standard pocket type knife. The housing has a channel molded into its wall with the top of the channel being open, allowing the side of the pocketknife to be visible when received in the channel on the flashlight. This allows the user to verify that the knife is in place. At the rear of the flashlight is a small closure device that is pivotally mounted to the rear of the flashlight. The closure device pivots into place flush with the bottom of the flashlight to retain the pocketknife once it is fully inserted into the channel in the flashlight.

16 Claims, 7 Drawing Sheets

FLASHLIGHT WITH REMOVABLE POCKET KNIFE

CROSS-REFERENCE TO RELATED APPLICATIONS

This application is related to and claims priority from earlier filed provisional patent application No. 60/306,517, filed Jul. 19, 2001.

BACKGROUND OF THE INVENTION

The instant invention relates generally to multi-purpose utility tools, and more particularly the present invention relates to a flashlight having a compartment for removably storing a standard pocket knife within the handle thereof.

Folding pocket knives with miniature flashlights incorporated into the handle have been known in the prior art. For example, U.S. Design Pat. Nos. D412,355 and D408,256 both disclose designs for a folding pocket knife having a small LED light element incorporated into the casing of the knife. Likewise, flashlights having foldable knife blades hingably mounted to the housing of the flashlight have also been known in the prior art. For example, the U.S. Design Pat. Nos. D353,011 and D350,271 each disclose such a flashlight.

The common feature of the prior art is that the handle of the primary tool also serves as the handle for the secondary tool. For the most part, these designs require a specifically designed housing, and more often than not, the design favors the functionality of the primary tool over the secondary tool, making the secondary tool difficult to use in some circumstances. In addition, the primary and secondary tools are not separable and therefore both tools could not be used contemporaneously by different persons.

There is therefore a need for a unique flashlight design that combines a storage compartment that can receive a standard pocket knife as an integral part of the device handle allowing for storage and for easy removal and use.

BRIEF SUMMARY OF THE INVENTION

In this regard, the present invention provides for a novel flashlight having a high intensity light source and including an integral storage capacity for receiving a standard construction folding pocket knife, as is well known in the art. The flashlight preferably includes a high intensity light source such as a light emitting diode (LED), a power source and a switching mechanism to selectively energize the light source, all contained within a housing. The flashlight housing is configured to have a docking compartment that slidably receives a standard folding pocket knife therein and a latching mechanism for retaining the knife within the compartment. In the preferred embodiments, the compartment is designed as a channel within in the handle of the flashlight, wherein the two sides and bottom of the channel are formed by the handle of the flashlight and the top side of the channel is essentially open. In this manner, when the knife is inserted into the channel from the end of the flashlight, one of the side casings of the knife is exposed and is retained in such a manner that the casing of the knife fills the open side of the channel flush with the handle of the flashlight handle. This provides an integrated look and feel to the overall product while also providing a quick visual and tactile means for determining whether the knife has been replaced in the channel compartment after use. Further, by positioning the pocket knife in this fashion, with one side casing being visible in the side of the flashlight handle, the indicia that may be printed on the casing of the knife are visible and appear to be integral to the flashlight as well. This separable design provides a significant advantage in marketing and advertising specialty channels wherein pocket knife manufacturers can private label brands, and/or print specialty advertising logos on the side casing of their pocket knives and bundle the knife with an added value flashlight.

Accordingly, one of the objects of the present invention is the provision of a small, lightweight, low cost flashlight having a superior brightness level and an integral means for removably storing a conventional pocketknife. Another object of the present invention is the provision of a flashlight having a handle that is formed to receive and store a conventional pocketknife wherein one of the side casing surfaces of the pocket knife is visible and appears integrated with the handle of the flashlight. A further object of the present invention is the provision of a flashlight having a high intensity light source and a handle that is capable of receiving a standard construction pocket knife and wherein the flashlight and the pocket knife can be used entirely independently when the pocket knife is not docked within the storage compartment.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
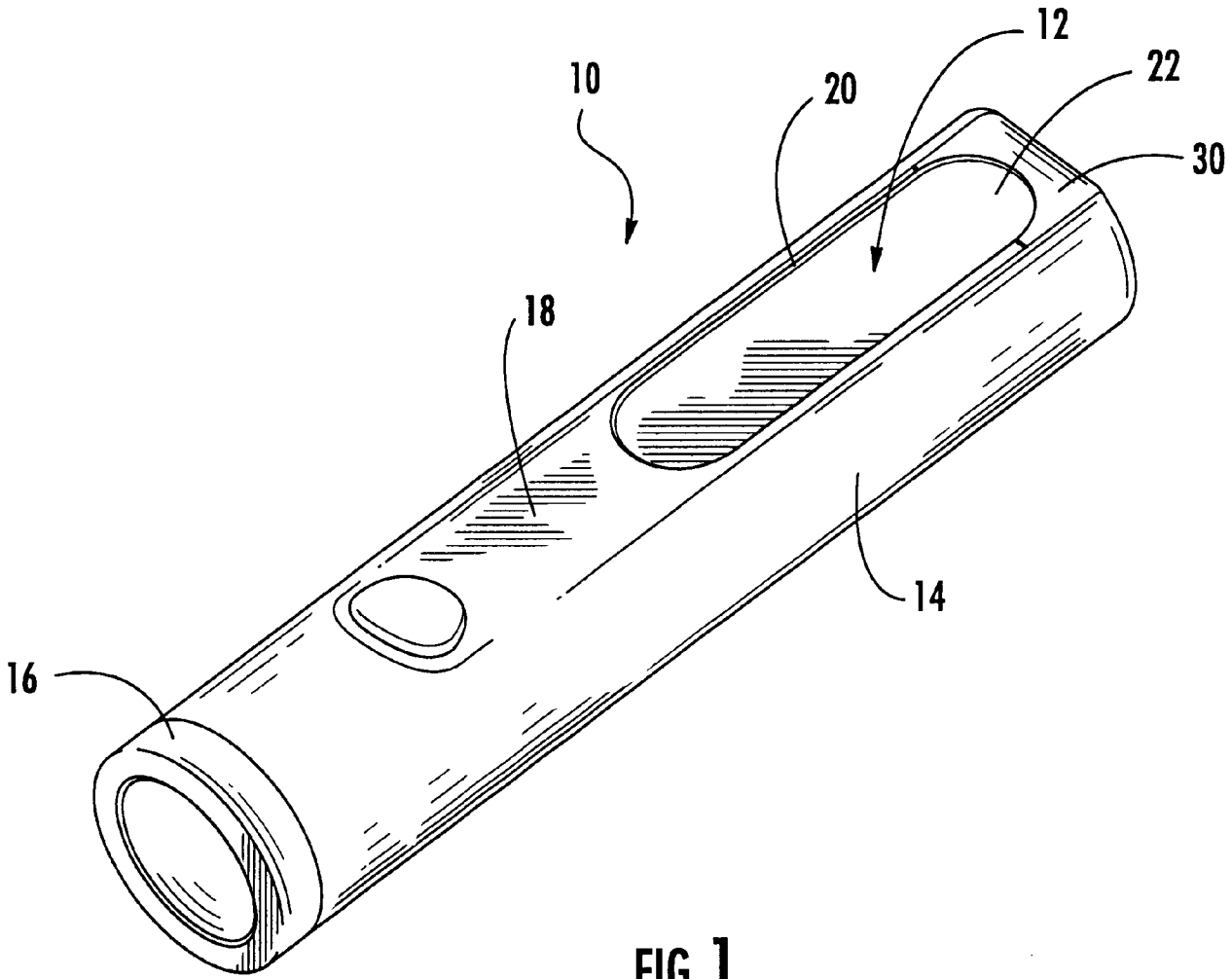
FIG. 1 is a perspective view of the miniature flashlight of the present invention.

Referring now to the drawings, the combination flashlight and pocket knife tool of the present invention is illustrated and generally indicated at 10 in FIGS. 1–7. The pocket knife is generally indicated at 12, while the flashlight is generally indicated at 14.

As will hereinafter be more fully described, the handle of the flashlight 14 is configured with a docking channel for removably receiving and holding the folding pocket knife 12. In operation, the pocket knife 12 can be completely separated from the flashlight 14 for use. The present invention therefore provides a convenient and economical combination tool 10 that has not been previously available in the prior art.

Figure 2:
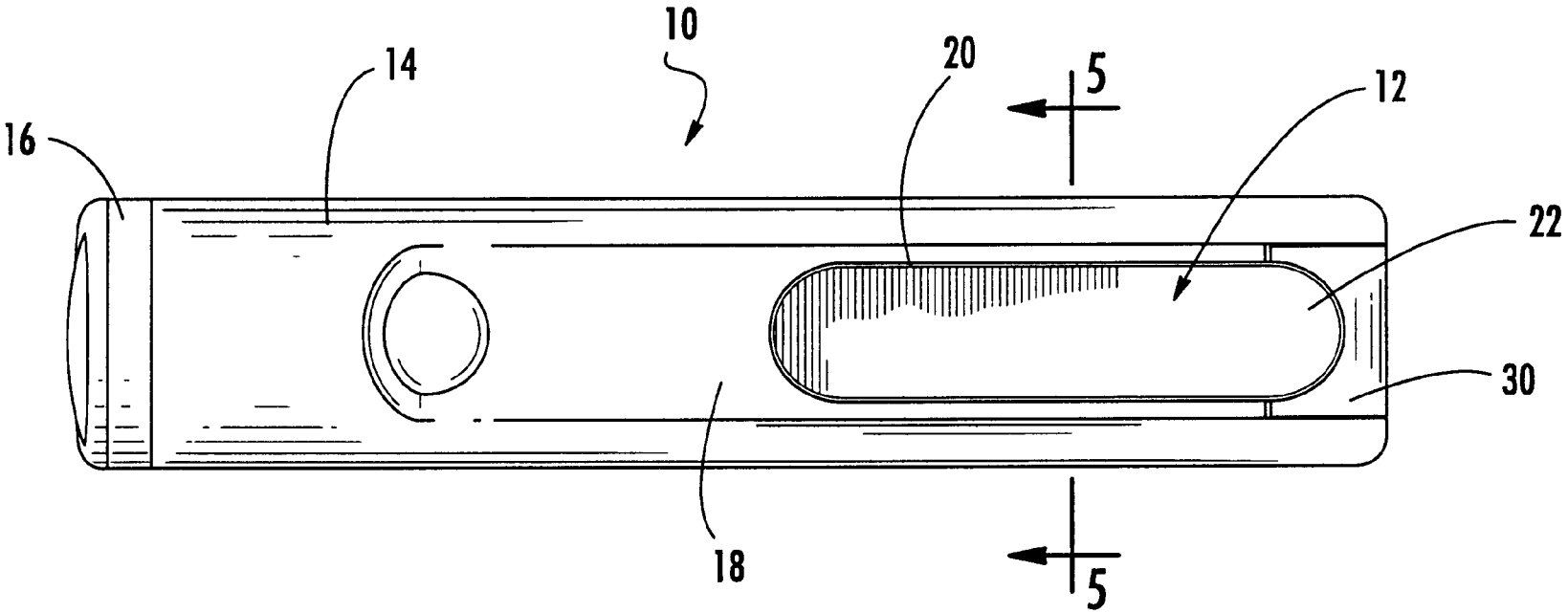
FIG. 2 is a top plan view thereof.

Turning to FIGS. 1 and 2, it can be seen that the flashlight 14 includes an outer tubular housing 15. The flashlight 14 further includes an operational light assembly generally indicated at 16, enclosed within one end of the housing 15, and an elongated, flattened display surface 18 adjacent the opposite end of the housing 15. The light assembly 16 is conventional in the art and will be further described below. The flattened surface 18 near the back of the housing 15 provides a flat area for a docking channel 20 into which the pocket knife 12 is received. The flashlight housing 15 further includes a retaining clip 30 at the back end of the housing 15 for selectively providing access to the open rear end of the docking channel 20, and for retaining the pocket knife 12 within the docking channel 20.

The retaining clip 30 in the preferred embodiment is shown to be pivotably mounted to the back of the flashlight housing 15. Once the knife 12 is inserted into the channel 20, the retaining clip 30 is pivoted into an engaged position to retain the knife 12. The retaining clip 30 has a positive latching mechanism such as raised pins 32 that engage small grooves 34 in the sides of the channel 20. The retaining clip 30 is shaped to smoothly integrate and match the shape of the housing 15 when it is received in the engaged position, thus appearing to smoothly integrate with the outer shape of the housing 15. While a pivoting clip 30 is shown, it should be appreciated that a number of other configurations where the clip slides, turns, rotates or is removed plainly also fall within the intent and scope of the present invention.

It can be seen in the preferred embodiment of the present invention 10 that a conventional 2-blade folding pocketknife 12 is illustrated. Smaller 2-blade pocket knives are known to be relatively thin in top to bottom thickness, and are thus preferred for integration into the present device over thicker multi-blade/multi-tool folding pocket knives including 4 or more tools. However, it is to be understood that larger folding pocket knives are contemplated within the scope of the invention in the context of larger flashlights. For aesthetic reasons, the pocket knife 12 may occupy only so much area of the housing 15 of the flashlight 14 before it detracts for the overall ornamental appearance of the construction. Larger pocket knives could be used. However, the housing 15 of the flashlight 14 would have to be proportionally larger.

The pocket knife 12 generally comprises a metal frame 13 having two blades 26 mounted to the frame 13. The blades 26 may be attached to the frame 13 by a pivot mechanism or by other sliding mechanisms as desired. The pocket knife 12 as illustrated contains pivoting blades 26. The blades 26 pivot from opposing ends of the frame 13 as is conventional in the pocket knife art. In the closed positions, the outer (non-cutting) edges of the blades 26 extend beyond the peripheral edge of the frame 35 to provide a gripping point for opening of the blades 26. This feature, as will be explained hereinafter, is important in retaining the pocket knife 12 within the docking channel 20. The opposing side surfaces of the metal frame 13 are covered with contoured decorative covers 22. The decorative covers 22 may be formed from plastic, or any other desirable material. Preferably, the covers 22 are suitable for engraving or printing of branding, advertising or marketing information. In particular, it is contemplated that the covers 22 will be molded from plastic. It is also contemplated that the pocket knife 12 may have a construction wherein the frame 13 and covers 22 are formed as a single piece, and therefore the covers 22 are not separate elements per se, but rather, are simply decorative surfaces on the sides of the frame 13.

The housing 15 of the flashlight 14 may also be molded from plastic or machined from a metallic material such as aluminum or stainless steel. The material of the housing 15, or for that matter, the knife frame 13, or the covers 22, is not particularly important to any of the patentable features of the invention. Although, it is preferred that the materials used for both the pocket knife casings 22 and the flashlight housing 15 are either the same or at least complementary in appearance.

Figure 3:
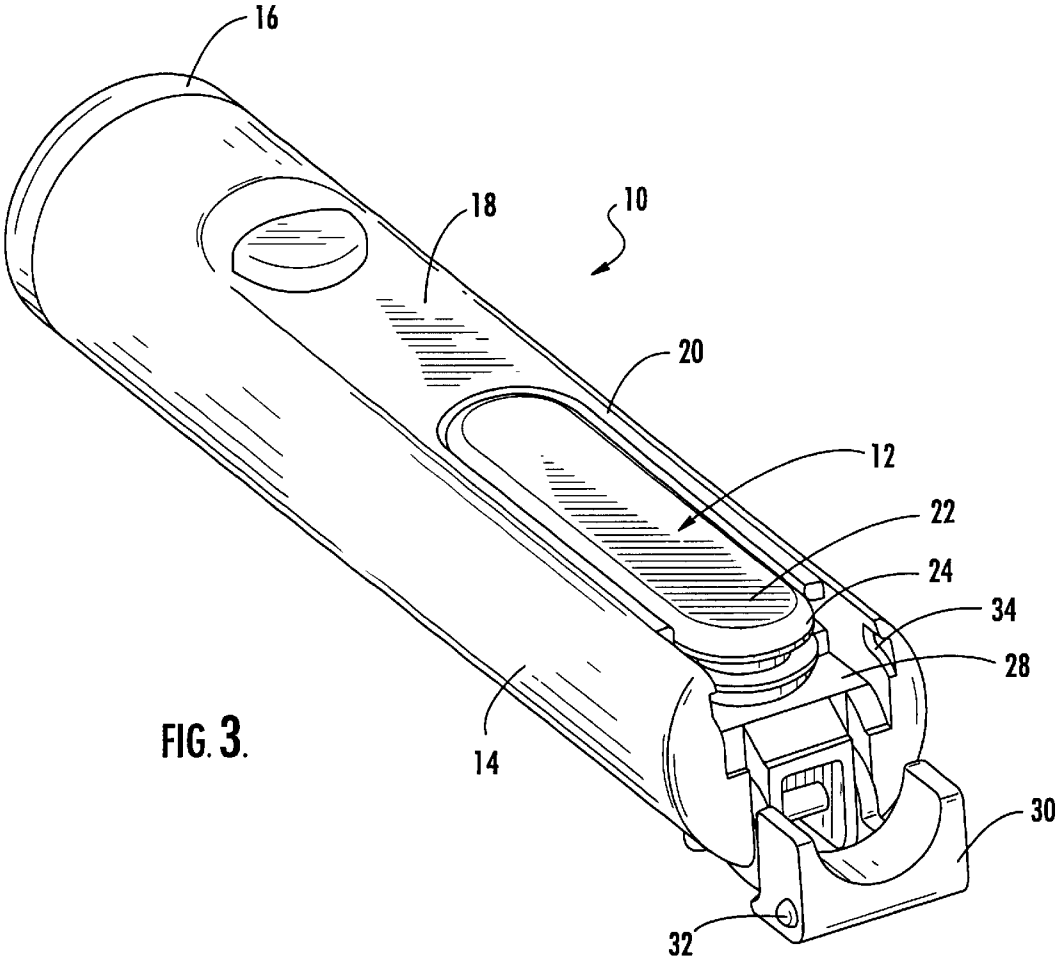
FIG. 3 is a perspective view from the rear thereof with the storage cover in the open position.
Figure 4:
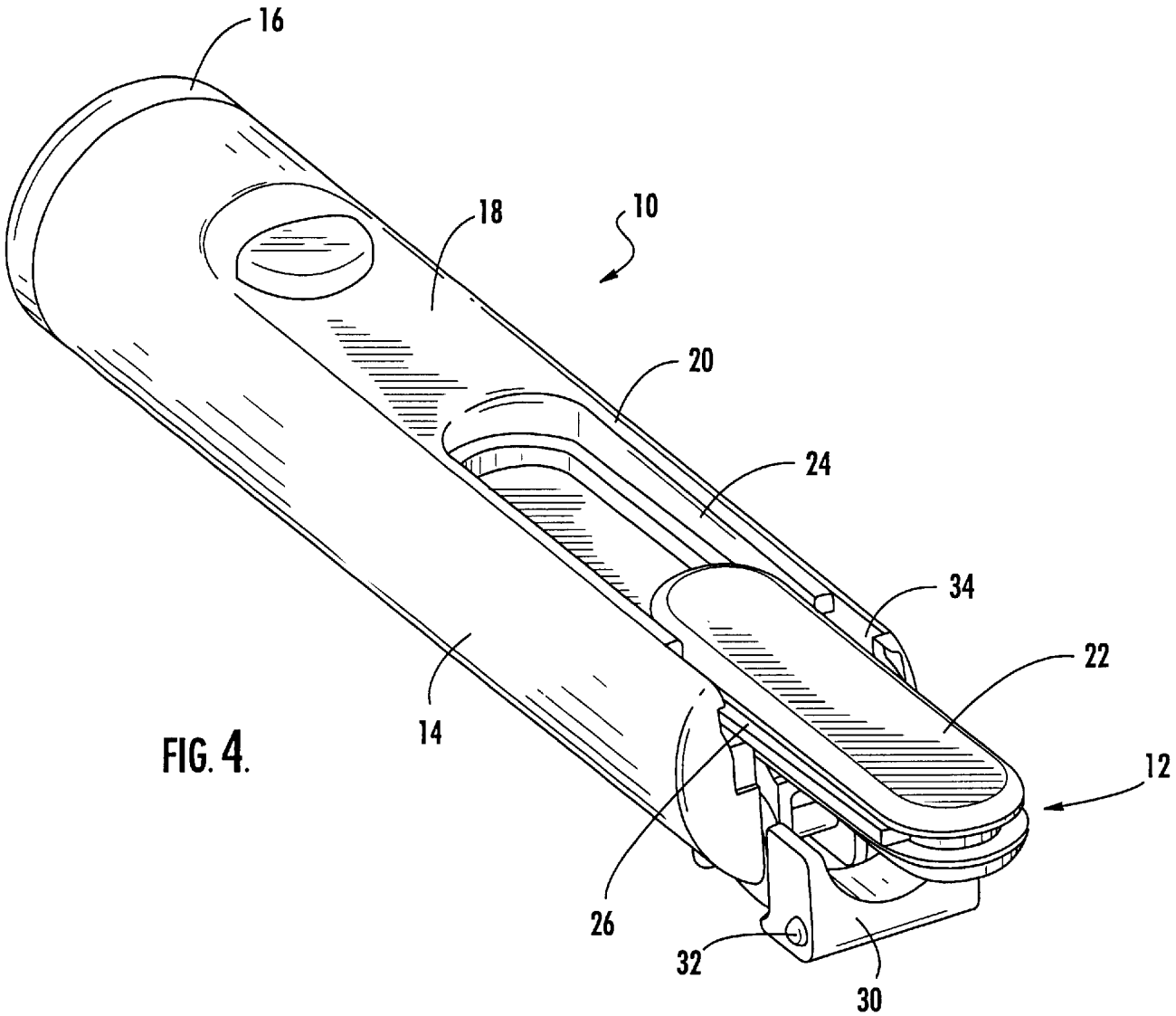
FIG. 4 is a perspective view from the rear thereof with the storage cover in the open position and the pocketknife partially removed.

Turning to FIGS. 3 and 4, the channel opening 20 in the surface of the flashlight housing 15 is preferably configured to interfittingly mate with the size and shape of the side covers 22 of the pocket knife 12. The channel 20 is configured with a bottom wall 28, two parallel side edges and a radiused inner end forming a side wall of the channel 20. In this manner, when the pocket knife 12 is slidably received into the channel 20 of the flashlight housing 15, one of the side covers 22 of the knife 12 is positioned in flush relation with the flat surface 18 in the housing 15 and thus appears to be an integral component of the flashlight housing 15. This mating design provides an integrated look and feel to the overall device 10. In addition, by allowing one side of the knife casing 22 to be exposed through the top of the channel 20, any indicia printed on the knife cover 22 is visible and appears to be printed on the side of the flashlight housing 15. This feature is desirable to both the pocket knife 12 manufacturer by allowing the indicia printed on the knife casing 22 to be displayed as well as to an organization that purchases the flashlight 14 for bundling with a pocket knife 12 on which they can print a personalized message.

Figure 5:
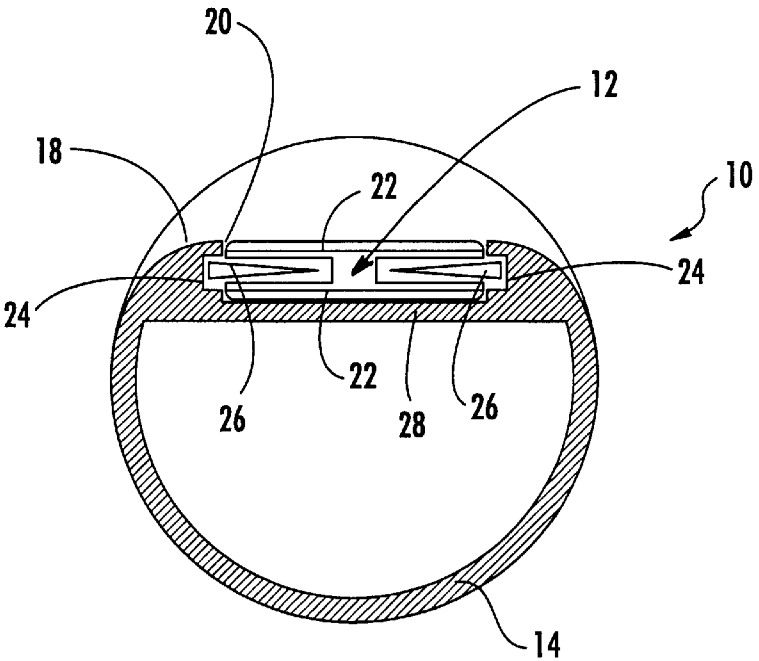
FIG. 5 is a cross-sectional view thereof as taken along line 5—5 of FIG. 2.

Still referring to FIGS. 3 and 4, the operation of the combination tool 10 of the present invention is illustrated. It can be seen in these two figures that two distinct features cooperate to receive and retain the pocket knife 12 within the channel 20. First, a groove 24 is provided in the sidewalls of the channel 20. These grooves 24 are an important feature of the present invention 10. As previously discussed and as can be seen in FIG. 4, the retractable blades 26 on the pocketknife 12 protrude slightly from the peripheral edges of the pocketknife 12 in their retracted position. The grooves 24 are located in such a manner that they receive these retracted blades 26 as the knife 12 is pushed into the channel 20 and engage the blades 26 to retain the knife 12 within the channel 20. The cooperative engagement of the grooves 24 and the blades 26 prevent the knife 12 from movement out of the open top of the channel 20. The relationship between the pocket knife 12, the housing 15, channel 20 and the grooves 24 is best illustrated in FIG. 5. The retracted blades 26 are shown engaged in the grooves 24 in the side wall of the channel 20 and the side casing 22 of the knife 12 can be seen to be received flush with the surface 18 of the housing 14.

The second feature that operates to retain the pocket knife 12 in the channel 20 is the pivoting retaining clip 30 provided at the back end of the housing 15. Once the knife 12 is inserted into the channel 20, the retaining clip 30 is pivoted into an engaged position to retain the knife 12. As indicated above, the retaining clip 30 has a positive latching mechanism such as raised pins 32 that engage small grooves 34 in the sides of the channel 20.

The channel configuration as described hereinabove provides an immediate visual confirmation to the user to verify whether the pocket knife 12 is assembled with the housing 15. Further, since the channel 20 is open, an operator of the present invention 10 can manually verify whether the knife 12 is in place without looking at the housing 15 by simply feeling the housing 15 of the flashlight 10. If the pocket knife 12 is in place, the channel 20 will be closed providing immediate tactile confirmation of the knife's 12 presence.

The present invention 10 represents a further improvement over the prior art in that the pocket knife 12 is completely removable from the channel 20 of the housing 15 wherein each element is operational independent of the other. The flashlight 16 is completely self-contained and the pocket knife 12 does not depend on the flashlight to serve as its own handle. In this manner, each of the tools is more versatile and functional in a more conventional manner as compared to an integrated combination tools of the prior art.

Figure 6:
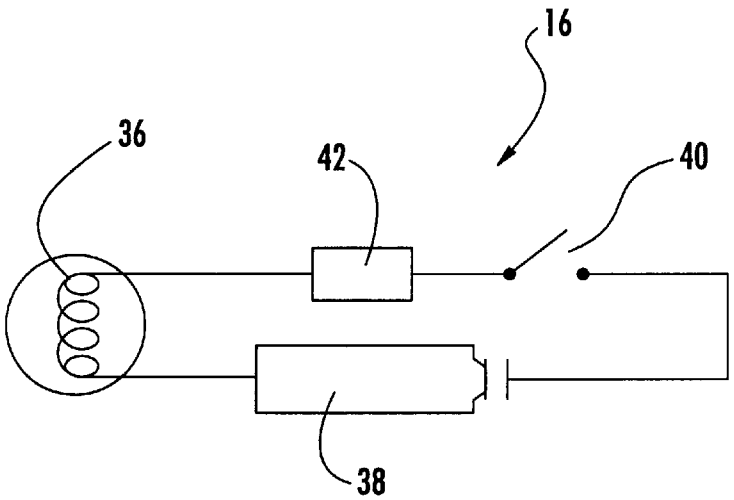
FIG. 6 is a schematic diagram generally illustrating the operational circuitry of the flashlight portion of the present invention.

Turning now to FIG. 6, and in conjunction with FIG. 1, a schematic view of the flashlight component 16 of the present invention 10 is shown. The flashlight component 16 includes a light source 36, a power source 38 and an actuator 40. The light source 36 may be any form of light producing element such as a filament containing light bulb, or in the preferred embodiment, a light emitting diode (LED). If an LED light source 36 is used, the circuitry in the flashlight 16 may also include conventional control electronics 42. While the general configuration of the flashlight 16 is described herein, it is not intended to be limiting as the flashlight component 16 is well known to any person skilled in the art and is intended to encompass any variation of flashlight configuration previously known. In addition, a lens or optical element may be placed in front of the light source to refine or focus the beam of light as desired.

Figure 7:
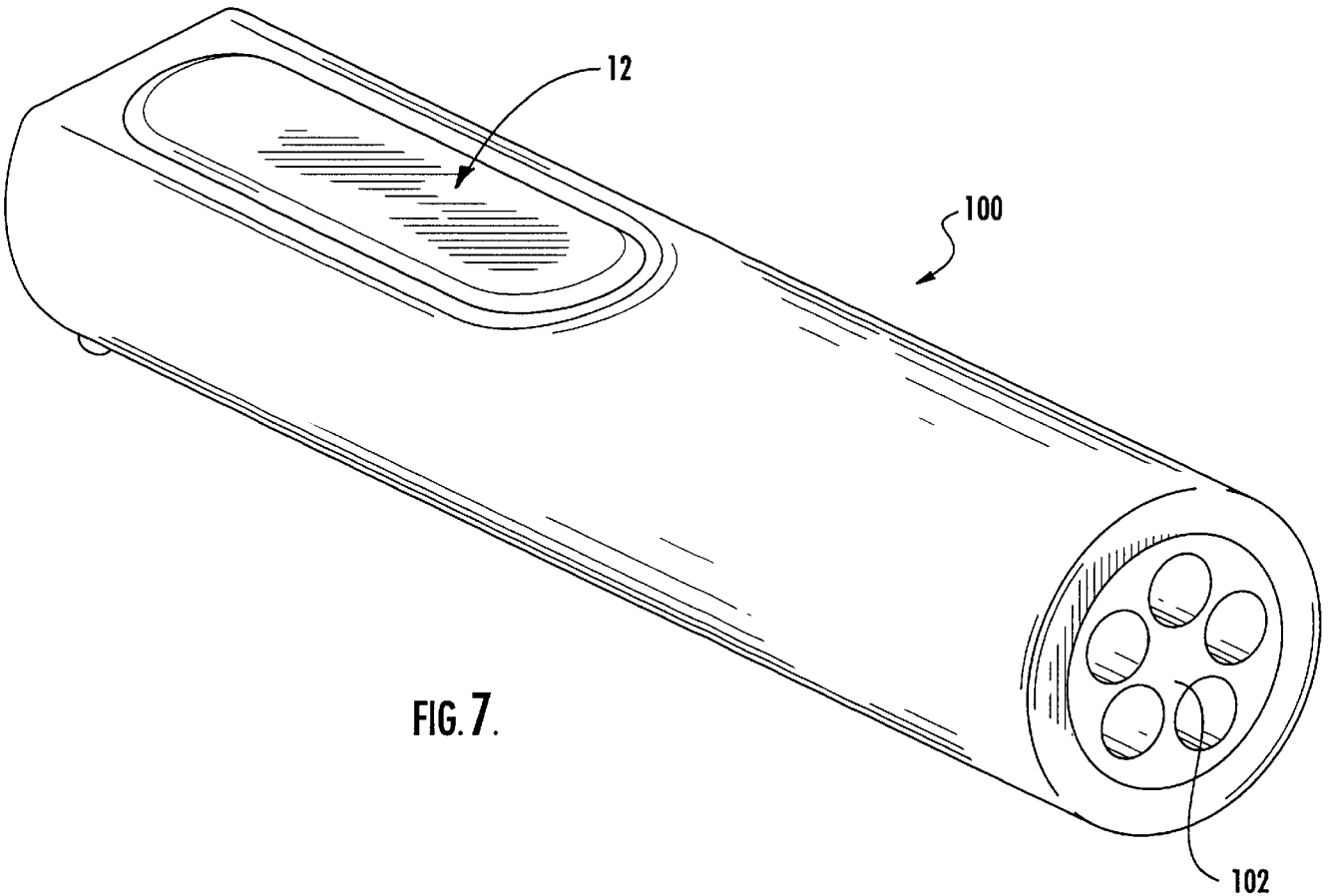
FIG. 7 is a perspective view of an alternate embodiment of the present invention.

FIG. 7 shows an alternate embodiment of the present invention 100 where all of the features are identical to those of the preferred embodiment except that the light source 36 is shown as an array of LED elements 102. In this manner, the present invention 100 may use a single light source 36 or any array of several light sources 102 in conjunction to form a single light source. Further, as described above, a control circuit 42 may be provided whereby a variety of different light configurations can be produced using the array of LED's 102.

It can therefore be seen that the present invention provides a small, lightweight, low cost tool 10 that provides an independent flashlight 14, and a pocket knife 12 that can be stored within the flashlight in a compact integrated structure. Further, the present invention can be modified to accommodate a number of standard pocketknife configurations to create a useful and novel flashlight. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A multipurpose tool comprising:

a flashlight having a housing, said housing having a front end, a back end, a top surface, and a channel configured within said top surface and extending inwardly from a peripheral edge of said back end of said housing, said channel having a bottom wall and opposing side walls extending upwardly from said bottom wall, and further having an opening in said side wall at said back end of said housing, said channel being configured to slideably receive a removable tool, said channel and said removable tool having complementary formations for interfitting engagement thereof; and a closure element movably coupled to said back end of said housing, said closure element being movable between a first open position away from said rear opening in said sidewall of said channel, and a second closed position received in mated relation over said rear opening in said sidewall of said channel.

2. The multipurpose tool of claim 1, wherein said removable tool comprises a pocketknife having a left and right side surface.

3. The multipurpose tool of claim 2, wherein said one of said left and right surfaces is flush with the top surface of said housing when said pocketknife is received in said channel.

4. The multipurpose tool of claim 3, wherein said pocket knife includes a frame and at least one blade extending beyond a peripheral edge of said frame, said blade engaging with a complementary groove in said channel to retain said pocket knife within said channel.

5. A flashlight assembly comprising:

a housing having a front end, a back end and a top surface;

a flashlight comprising a light source, a battery, control circuitry and a means for actuating said flashlight in said front end of said housing;

a channel in said housing proximate to said back end of said housing, said channel having a bottom wall and a side wall extending upwardly between said bottom wall and said top surface with an opening in said side wall at said back end of said housing, said channel having mating formations adapted to slideably receive a removable tool through said opening in said side wall; and a closure element pivotably connected to said back end of said housing, said closure element being pivotable from a first open position to a second closed position over said opening in said sidewall wherein said closure element in said closed position retains said removable tool in said channel.

6. The flashlight of claim 5, wherein said light source is a light emitting diode.

7. The flashlight of claim 5, wherein said light source is an array of light emitting diodes.

8. The flashlight of claim 5, wherein said removable tool is a pocketknife having a left and right side surface.

9. The flashlight of claim 8, wherein said one of said left and right surfaces is flush with the top surface of said housing when said pocketknife is received in said channel.

10. A flashlight comprising:

a substantially tubular housing having a first end, a second end and a top surface;

a flashlight assembly received in said first end comprising, at least one light emitting diode, a battery and a means for selectively energizing said light emitting diode; and a means for retaining a removable tool including, a channel in said top surface of said housing proximate to said second end, having a bottom wall and a side wall extending between said bottom wall and said top surface, said side wall having an opening at said second end of said housing, a linear groove extending along said side wall between said bottom wall and said top surface, said channel and linear groove cooperating to slideably receive and retain said removable tool, and a closure element pivotably connected to said second end of said housing, said closure element being pivotable from a first open position to a second closed position over said opening in said side wall wherein said closure element in said closed position retains said removable tool in said channel.

11. The flashlight of claim 10, wherein said at least one light emitting diode is an array of light emitting diodes.

12. The flashlight of claim 10, wherein said removable tool is a pocketknife having a left and right side surface.

13. The flashlight of claim 8, wherein said one of said left and right surfaces is flush with the top surface of said housing when said pocketknife is received in said channel.

14. In combination, a pocketknife comprising:

a frame having opposing, symmetrical side surfaces;

at least one blade movably mounted to said frame between said side surface, said blade being movable between an open position and a closed position wherein an outer edge of said blade extends beyond a peripheral edge of said side surface; and a flashlight comprising:

a housing having a front end, a back end, a top surface, and a channel configured within said top surface, said channel having a bottom wall and opposing side walls extending inwardly from a peripheral edge of said back end of said housing and terminating at a front wall, said channel being configured to slideably receive said pocket knife in interfitting mated relation therein, said channel and said pocket knife having complementary formations for interfitting engagement thereof; and a closure element movably coupled to said back end of said housing, said closure element being movable between a first open position away from said back end of said housing, and a second closed position received in mated relation over said back end of said housing.

15. The combination of claim 14, wherein said side edges of said channel include grooves for receiving said outer edge of said blade of said pocket knife.

16. The combination of claim 14, wherein one of said side surfaces of said pocket knife is flush with the top surface of said housing when said pocketknife is received in said channel.

* * * * *